US005297607A

United States Patent [19]

Beauchamp

[11] Patent Number: 5,297,607

[45] Date of Patent: Mar. 29, 1994

[54] SHEET CURTAIN WITH VERTICAL BLIND ACTUATING MECHANISM

[76] Inventor: Pierre Beauchamp, 17, Place Kieffer, Dollard-des-Ormeaux (Quebec), Canada, H9B 1H9

[21] Appl. No.: 990,798

[22] Filed: Dec. 15, 1992

[51] Int. Cl.[5] ..... E06B 9/06

[52] U.S. Cl. ..... 160/84.1 C

[58] Field of Search ..... 160/84.1 C, 89, 330, 160/348, 84.1 R

[56] References Cited

U.S. PATENT DOCUMENTS

| | | | |
|---|---|---|---|
| 3,286,299 | 11/1966 | Golden | 160/330 X |
| 3,369,589 | 2/1968 | Benkert, Jr. | 160/84.1 C |
| 3,844,330 | 10/1974 | Hyman | 160/84.1 C X |
| 3,851,699 | 12/1974 | Shapiro | 160/330 X |
| 3,946,789 | 3/1976 | Ronkholz-Tolle | 160/84.1 C X |
| 4,390,055 | 6/1983 | Fenley | 160/348 |
| 4,884,612 | 12/1989 | Schnebly et al. | 160/89 X |
| 5,012,552 | 5/1991 | Wulf | 160/89 X |

*Primary Examiner*—Blair M. Johnson
*Attorney, Agent, or Firm*—Pierre Lespérance; Francois Martineau

[57] ABSTRACT

The curtain consists of a single, translucent, yet untransparent fabric sheet, hung to sliders carried by a track, the latter track anchored in horizontal position against a vertical wall above a window frame. A cord at the end of the track operates the sliders to both slide the curtain sheet lengthwisely of the track, to fold/unfold in accordeon like the curtain sheet for extending/retracting same, as well as tilt the sliders about their vertical axes, as with a vertical blind actuating mechanism. The drape has a wavy configuration, whereby as the sliders are pivoted by the control cord, the amount of light traversing the drapes will adjustably vary in a progressive fashion. Each slider includes a cardboard plate, lodged into a pocket made at the top edge portion of the drapes, and releasably engaged by a slider hook.

8 Claims, 3 Drawing Sheets

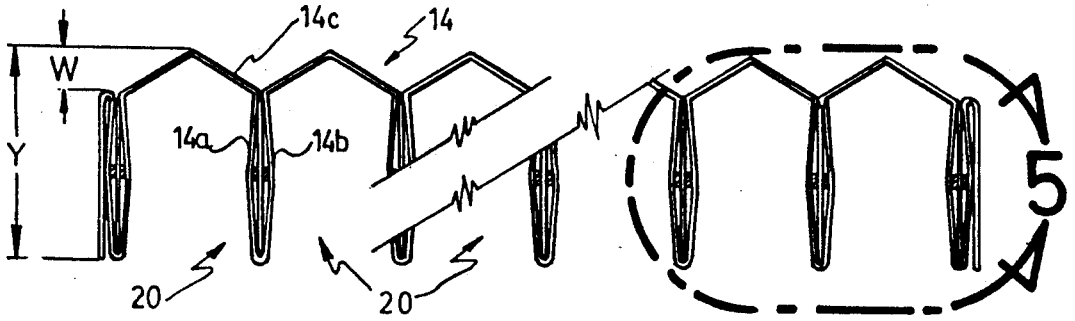
Fig.3
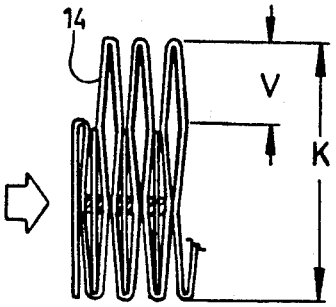
Fig.4
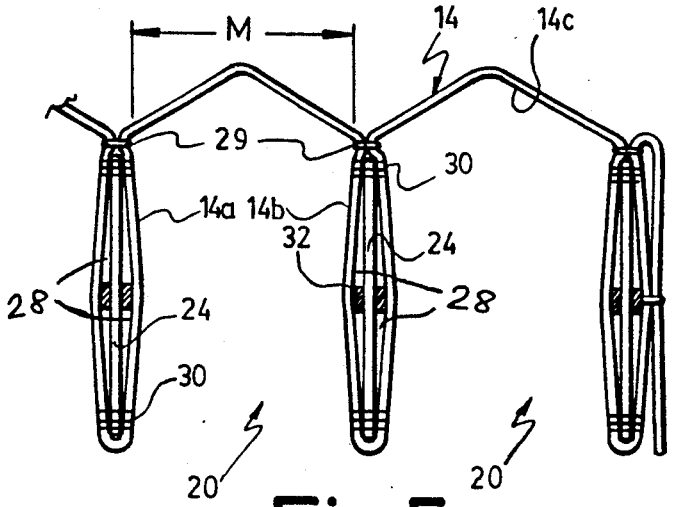
Fig.5
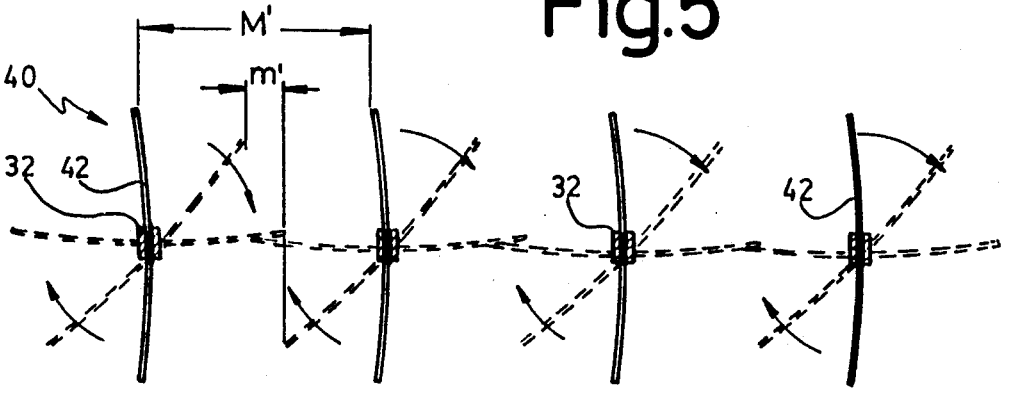
(PRIOR ART) Fig.6

SHEET CURTAIN WITH VERTICAL BLIND ACTUATING MECHANISM

FIELD OF THE INVENTION

This invention relates to flexible window coverings, particularly those that fold like conventional vertical blinds.

BACKGROUND OF THE INVENTION

In U.S. Pat. No. 3,844,330 issued in 1974 to Louver-Drape, Inc., there is disclosed a window covering system using conventional vertical blind hardware employed with vertically disposed louvers. The drape sheet has a generally wavy configuration, and is attached to the louvers so that as the louvers rotate about their vertical axes, each of the successive drape sheet sections progressively fold from a first position (FIG. 2), generally transverse to the window frame, to a second position, generally parallel to the window frame and edgewisely abutting against each other in successive pairs (see FIG. 3). A normal drape like effect is thus obtained, which further has the capability of varying the degree of opaqueness of the drape, i.e. the amount of light that can traverse the drape.

According to this 330' patent, the flexible drape sheet material is hung from the upper portion of each louver, and each louver is to extend the full height of the window frame, see column 2, lines 45–67 of this latter patent. It is further envisioned that these louvers be either plane, to achieve a minimum profile when perpendicularly disposed with respect to the window, or slightly curved, to provide increased bending and torsional rigidity.

According to the present inventor, it is not desirable to provide a louver extending the full height of the drapes, in that the opaqueness of the louver itself will interfere with that of the drape, and thus substantially reduce the light adjusting capability of the drape system.

Another pertinent reference is U.S. Pat. No. 3,851,699 issued in 1974 to Harry SHAPIRO. In this patent, vertical louvers 23 are anchored at their top edges to the top edges of a flexible drape 16, by rivets 24. The conventional hanger slides 26, carried along horizontal track 27, controls the orientation of the louvers 23 to which they are connected. The louvers extend for the full vertical length of the drapes. Clearly then, such an arrangement requires structural modifications to an existing vertical louver assembly - notably, the installation of rivet means 19, 24 on the slat 23 and on the drapes 19) before the louver assembly can be transformed into a louver type drape means.

OBJECTS OF THE INVENTION

It is therefore a general object of this invention to improve upon U.S. Pat. Nos. 3,844,330 and 3,851,699.

A more specific object of the invention is to provide a vertical louver type window drape, which can be reversible simply by inverting the horizontal track (bringing the aft end thereof in front, and vice-versa), while maintaining the attractive visual appeal thereof.

A further object of the invention is to provide such a louver type drape, which will be compatible to existing, already installed, louver assemblies, without any structural modifications being called upon.

Still another object of the invention is that the above-noted louver type drape be capable of continuously adjusting the light-diffusing ratio through the drape.

An object of the invention is that the above-noted louver-type drape require very little skill for its installation, and little time to complete the installation.

Another object of the invention is that the present louver-type drape could be installed to a track mounted either on the roof or the (upright) wall of a room.

An object of the invention is that the present louver-type drape would allow a variety of contours for the drape pleating, including traditional and tubular type pleatings.

An object of the invention is that the whole curtain, including the pocket vinyl templates, may be cleaned without disassembly, upon release from the carrier track.

SUMMARY OF THE INVENTION

In accordance with the teachings of the invention, there is disclosed, in combination, an integral, flexible, translucent yet untransparent sheet curtain, defining a width and having a substantially straight, top edge section, means for suspending said curtain spacedly over ground by said top edge section thereof, means for biasing said curtain into a generally wavy configuration about its said width, whereby a plurality of first, generally open pockets are defined successively about said curtain width, each one of said sheet curtain first pockets defining a sheet curtain section base and two generally parallel sheet curtain section side legs, and means for tilting in unisson said sheet curtain section side legs from a first limit position, in which said side legs are generally orthogonal to said curtain section bases and said first pockets are generally open, through an intermediate position, in which said side legs are oblique relative to said curtain section bases and said first pockets are partially closed, to a second limit position, in which said side legs are generally parallel to said curtain section base legs and edgewisely abut in successive pairs against one another and said first pocket becomes generally closed; wherein said tilting means consists of a number of rigid, polygonal, flat members, each polygonal member being freely engaged into a curtain sheet second, generally closed pocket defined by adjacent sheet sections from two successive said first pockets, each said second pocket being located at the top edge portion of said curtain far away from the bottom edge portion thereof so that most of said curtain sheet hangs freely beneath said polygonal members, each said second pocket defining top seat means against which edgewisely bears a corresponding said polygonal member, and means for supporting said polygonal member over ground and for pivoting same about a vertical axis.

BRIEF DESCRIPTION OF THE DRAWINGS

FIGS. 3–4 are sectional views taken along lines 3—3 and 4—4 of FIGS. 1 and 2, respectively, FIG. 3 being partly broken;

FIG. 5 is a view at an enlarged scale of the area circumscribed in ellipse 5 of FIG. 3;

FIG. 6, on the second sheet of drawings, is a view similar to FIG. 3, but showing prior art venetian blinds in open condition, in full lines, in edgewisely overlapping closed condition in phantom lines, and also in a position intermediate the open and closed conditions thereof also in phantom lines;

DETAILED DESCRIPTION OF THE INVENTION

Figure 2:
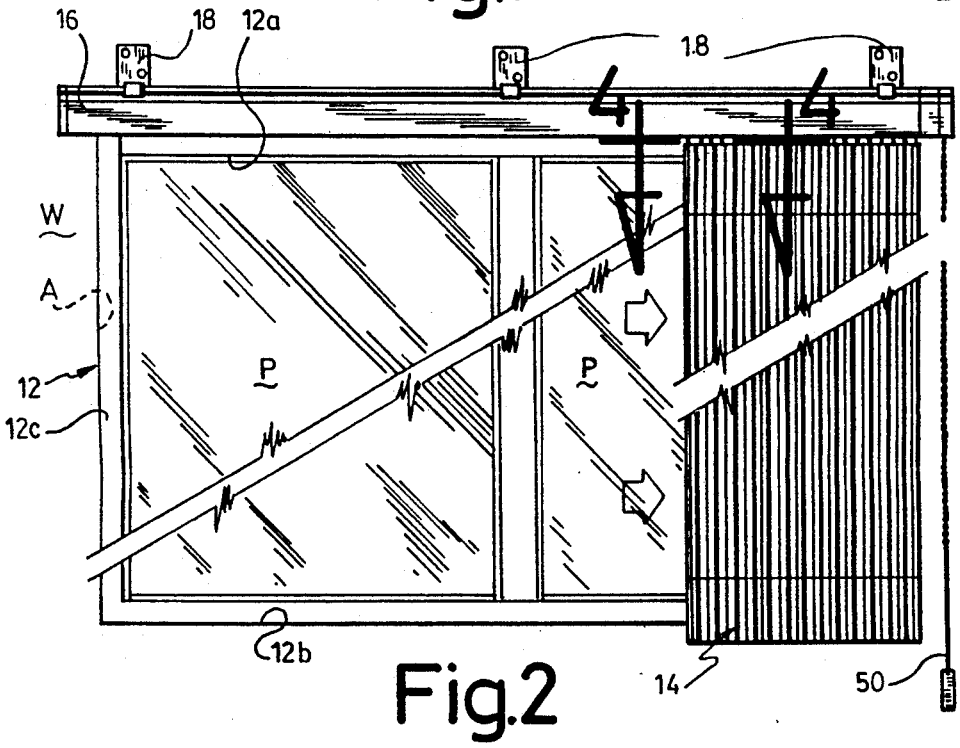

Quadrangular window frame 12—illustrated in FIG. 2—defines a top leg 12*a*, a bottom leg 12*b*, two opposite lateral side legs 12*c*, 12*d*, legs 12*a*–12*d* surrounding one or more window panes P. Window pane P is transparent or at least translucent, being e.g. manufactured from glass or a plastic material. Window frame 12 fits inside an aperture A made in a vertical wall W.

Figure 1:
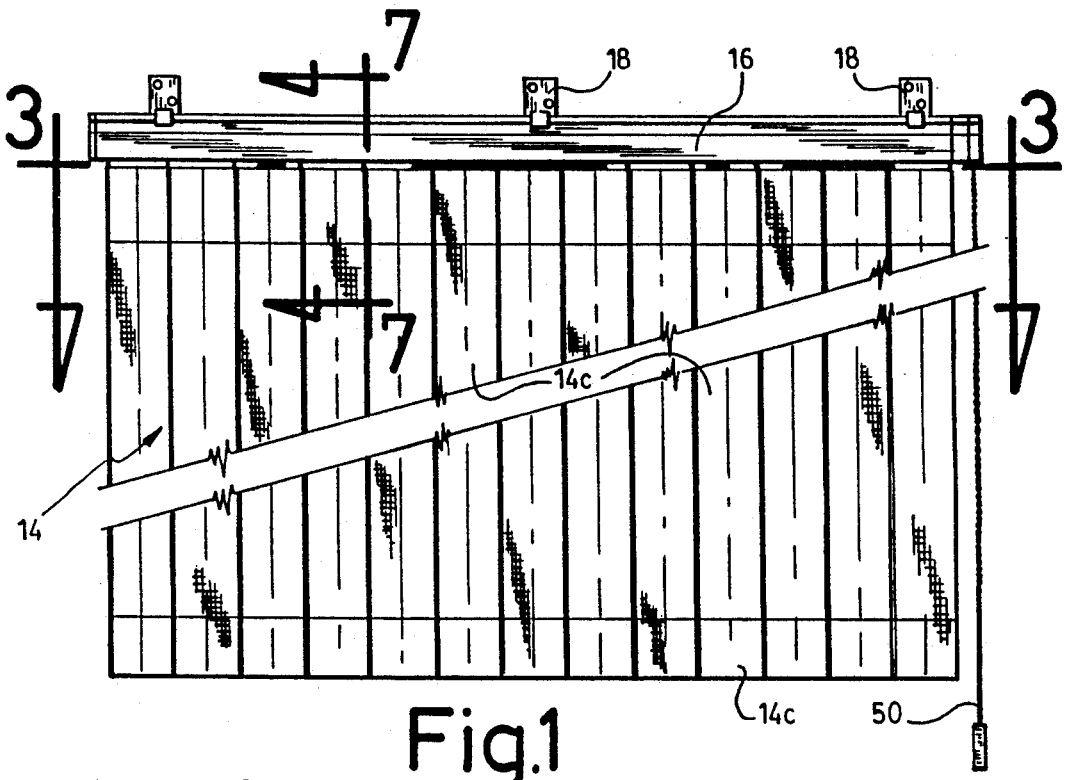
FIGS. 1–2 are front elevational views of a double window frame, being provided with a preferred embodiment of curtain according to the invention, respectively in extended and retracted conditions.
Figure 5A:
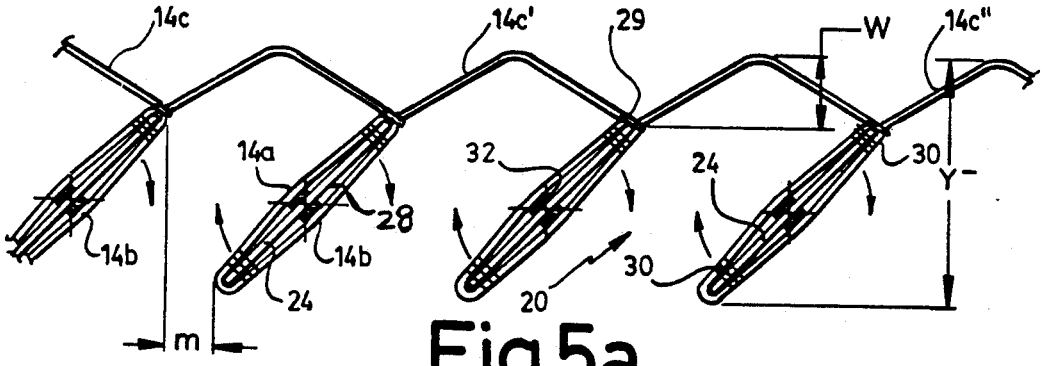
FIG. 5*a* and 5*b*, on the third sheet of drawings, are views similar to FIG. 5, but sequentially suggesting how the present extended curtain can be progressively pivoted from its open condition (FIG. 5) to its closed condition (FIG. 5*b*)
Figure 5B:
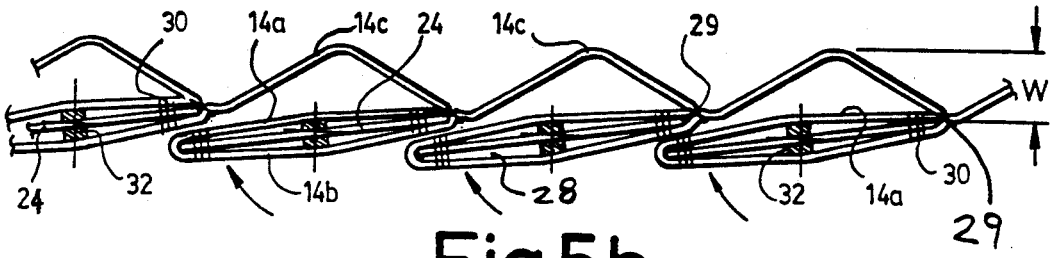

A sheet curtain 14 is edgewisely carried spacedly ahead of glass panes P, by tracks 16 being anchored horizontally to wall W by a few brackets 18 located above the top (horizontal) leg 12*a* of window frame 12, whereby curtain 14 hangs from track 16. Curtain 14 is made from a single sheet of flexible, translucent yet untransparent material, e.g. from a suitable fabric material. Curtain 14 is biased by biasing means—e.g. prestressed cardboard inner filling—into a generally wavy pattern, forming a plurality of vertical open pockets, as suggested in FIGS. 3 and 5. A plurality of slider members 22 are anchored at selected, spaced intervals of the top edge 14*a* of curtain 14, and are freely carried by track 16 for both sliding motion lengthwisely of track 16 and pivotal motion about axes transverse of track 16. That is to say, curtain 14—which is destined to have a height such that its bottom section reaches downwardly beyond the bottom leg 12*b* of window frame 12—is extendable from a "retracted" condition, shown in FIG. 2 and in which the slider members 22 are grouped in successive abutting pairs and the curtain sheet folded to conceal only part of a lateral side portion of the window frame glass pane P, to an "extended" condition, shown in FIG. 1 and in which the slider members 22 are spread apart and the curtain sheet unfolded while still maintaining its wavy configuration. Moreover, that is to say that each curtain pocket 20 is also progressively closable by pivotal motion about the vertical axes of the sliders 22—see the sequence of FIGS. 5, 5*a* and 5*b*. During this latter pivotal closing motion of the pockets 20, and as will be detailed hereinbelow, the amount of light traversing the curtain will progressively diminish.

Each slider member 22 consists of a rigid, quadrangular, flat template or panel 24, being provided with at least one, and preferably up to four edge bores 26*a*, 26*b*, 26*c*, 26*d*. Panel 24 is sandwiched between two successive sections 14*a*, 14*b*, of sheet curtain 14, these sections 14*a*, 14*b*, defining a generally closed pocket 28. Each pocket 28 is maintained closed by a vertical stitch line 29, which stitches together the inner edges of sheet sections 14*a* and 14*b*. Each pair of successive closed pockets 28, 28, are spaced by an open pocket 20, and bridged by a transverse, elbowed, curtain sheet section 14*c*. Panel 24 edgewisely bears against a few horizontally spaced seat means 30, forming seats made at the top edges of sheet sections 14*a*, 14*b*.

A selected one of panel bores 26*a*, 26*b*, 26*c* or 26*d* is engaged by a hook member 32 (FIG. 7) that downwardly depends from track 16 and is slidingly movable therealong. Accordingly, the seat means 30 must be horizontally spaced, to clear the way for free passage of the (vertically depending) slider hook 32 which is carried by the track 16 for horizontal motion therealong.

It is understood that, as the successive pairs of wavy sections 14*a*, 14*b* from translucent curtain 14 tilt from their open conditions (FIGS. 1 and 5) to their closed conditions (FIG. 5*b*), the amount of light diffusing throught the curtain will decrease. The reason is that instead of a single curtain sheet layer (14*c*) extending parallel to glass pane P (when curtain 14 is open—FIG. 5), there are now three full layers of curtain sheets (14*a*, 14*b*, 14*c*) extending parallel to glass pane P and in register with one another, with all the closed pockets 20 being coextensive to one another. Light directed through the curtain thus needs to go through three layers of sheet 14, instead of a single one. Since the sheet 14 is not transparent, the higher the number of sheet layers, the greater light absorption will occur, and thus, the smaller the amount of light will be allowed to pass through the curtain.

In view thereof, it is important that each skeleton panel 24 be of relatively small size, that is, should be limited to the upper edge portion of curtain 14. More particularly, rigid panel 24 should definitely not extend all the height of curtain 14, to the bottom edge thereof, since panel 24 would impede upon the light diffusing capability of the sheet fabric 14. Hence, most of sheet material 14 will hang freely beneath the various cardboard panels 24.

FIG. 6 shows, in a top plan view, a conventional venetian blind window screen 40 (prior art), suggesting several different orientations of the cross-sections of slats 42 from an opened position (full lines) to intermediate and closed positions (in dotted lines). Slats 42, as in known in the art, are elongated and lengthwisely rectangular, having a cross-sectional either flat or concave (FIG. 6 showing concave slats). Since conventional slats 42 are provided with a transverse bore (not illustrated), similar to bores 26*a*–26*d* of template 24, at their upper end portion, the curtain 14 of the present invention would be interchangeable with a plurality of conventional slats 42. The slider hooks 32 slidingly mounted to the rail 16 would releasably engage alternately the slats 42, or the templates 24 of curtain 14, interchangeably. Track 16 could consequently carry either conventional slats 42 or curtain 14 of the present invention. Of course, in this alternate embodiment, vertical slats 42—contrary to rectangular cardboard frame 24—would extend downwardly for the full height of the window P. For cost-conscious buyers, this additional capability will improve their value for money perception of the product, thus enhancing prospect of sale completion.

Figure 7:
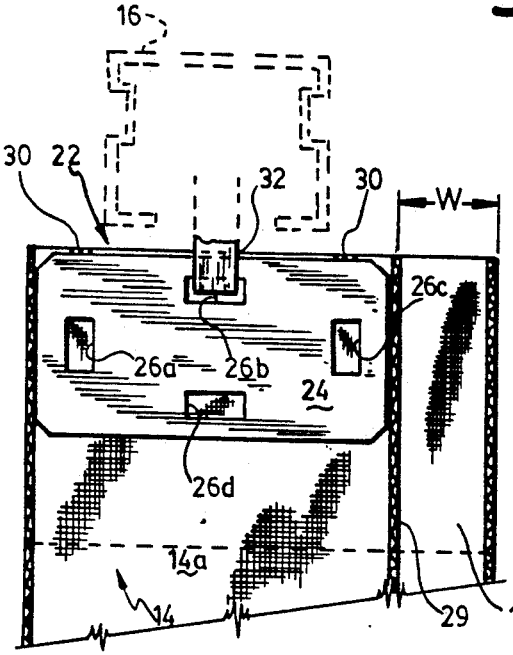
FIG. 7 is an enlarged cross-section along line 7—7 of FIG. 1.
Figure 8:
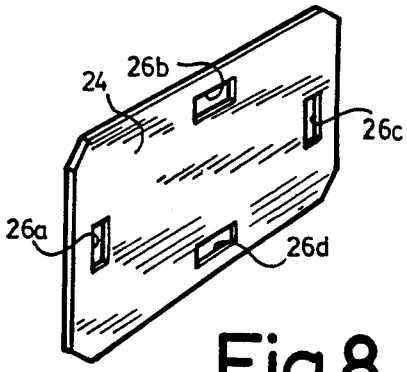
FIG. 8 is an isometric view of one of the rigid templates shown in FIG. 7, installed at successive upper sections of the curtain.

In FIG. 7, the seat means 30 against which edgewisely bears tab 24—to maintain the latter into pocket 28, and therefore, to interconnect track slider 32 and curtain 14—may be of any suitable type, e.g. spot tacks or short transverse stitch points, joining the top edges of fabric sheet sections 14*a* and 14*b*.

The pair of stitch points 30, 30, illustrated in FIG. 7 are laterally (horizontally) spaced, to clear the way for free passage of transverse slider hook 32.

It is also understood that each vertical stitch line 29—which joins together the inner edges of sheet curtain sections 14*a*, 14*b*—constitutes both the hinge means, about which the pockets 20 tilt during curtain closing, as well as the bridge between two elbowed base legs 14*c*, 14*c*', of two successive pockets 20, 20.

By rotating rectangular panel 24 by a quarter of a turn, from horizontal to vertical orientation, and securing track hook 32 into the corresponding top bore, e.g. 26*c*, a shallower curtain is obtained—i.e. with pockets 20 of a smaller horizontal depth. The visual appearance will again be modified to the benefit of the discriminating customer: a "third" curtain will be obtained at no extra cost. Also if a bore is damaged (i.e. becomes notched from wear and tear), rotating half a turn the plane 24 provides a fresh (undamaged) bore (e.g. 26*d*). Still further, the orientation of the pockets 20 may be selected as being directed either toward or away from glass pane P—i.e. the whole curtain being rotated half a turn: a "fourth embodiment" of curtain will then be obtained still at no extra cost.

Opening/closure of generally open pockets 20—through vertical pivotal bias being applied to track hook 32—(FIGS. 5, 5*a*, 5*b*) and/or extension/retraction of the curtain 14—through horizontal displacement of hooks 32 along track 16—can be controlled in the conventional fashion by elongated cable 50 (FIGS. 1-2) hanging at one end of track 16.

Rigid plate 24 could be square, rectangular, or even polygonal, provided it holds at its periphery at least one hooking bore. But preferably, panel 24 is made of rigid vinyl, and has a rectangular shape to allow for two different widths of each wavy drape pocket 20 upon the rectangular panel being rotated a quarter of a turn.

It is understood that, in the present invention, the rigid slider template 24 is never directly anchored to the flexible drape sheet 14—it simply abuts edgewisely against the horizontally spaced top stitches 30, 30, (under the upward bias of the track hook 32 which supports the template 24) and is prevented from horizontal motion along the drape sheet 14 by the vertically extending pair of opposite stitches 29, 29, forming each corresponding pocket 20. Template 24 is therefore freely engaged into the small top pocket 20.

Because the pocket 20 is limited to a small top portion of the total height of the curtain 14, the rigid rectangular template 24 will not impede upon the capability of the main portion of the sheet curtain 14 (beneath pocket 20) to disclose all the desirable visual appeal features of flexible drape sheeting.

I claim:

1. In combination, an integral, flexible, translucent yet untransparent, sheet curtain, defining a width and having a substantially straight, top edge section, means for suspending said curtain spacedly over ground by said top edge section thereof, means for biasing said curtain into a generally wavy configuration about its said width, whereby a plurality of first, generally open, vertical pockets are defined successively about said curtain width, each one of said sheet curtain first pockets defining a sheet curtain section base and two generally parallel sheet curtain section side legs, and means for tilting in unisson said sheet curtain section side legs from a first limit position, in which said side legs are generally orthogonal to said curtain section bases and said first pockets are generally open, through an intermediate position, in which said side legs are oblique relative to said curtain section bases and said first pockets are partially closed, to a second limit position, in which said side legs are generally parallel to said curtain section bases and edgewisely abut in successive pairs against one another and said first pocket becomes generally closed; wherein said tilting means consists of a number of rigid, polygonal, flat members, each polygonal member being freely engaged into a curtain sheet second, generally closed pocket defined by a pair of adjacent sheet sections from two successive said first pockets, each said second pocket being located at the top edge portion of said curtain far away from the bottom edge portion thereof so that most of said curtain sheet hangs freely beneath said polygonal members, each said second pocket defining top seat means against which edgewisely bears a corresponding said polygonal member, and means for supporting said polygonal member over ground and for pivoting same about a vertical axis; wherein said polygonal member includes a few peripheral bores spaced from one another, said supporting means including a plurality of hook members destined to slidingly engage a horizontal track, said horizontal track of the type to be anchored horizontally over a window frame to be concealed by said curtain, each said hook member destined to engage a selected one of said bores from a corresponding one of said polygonal members.

2. A sheet curtain as defined in claim 1, wherein each said polygonal member is rectangular.

3. In combination, an integral, flexible, translucent yet untransparent, sheet curtain, defining a width and having a substantially straight, top edge section, means for suspending said curtain spacedly over ground by said top edge section thereof, means for biasing said curtain into a generally wavy configuration about its said width, whereby a plurality of first, generally open, vertical pockets are defined successively about said curtain width, each one of said sheet curtain first pockets defining a sheet curtain section base and two generally parallel sheet curtain section side legs, and means for tilting in unisson said sheet curtain section side legs from a first limit position, in which said side legs are generally orthogonal to said curtain section bases and said first pockets are generally open, through an intermediate position, in which said side legs are oblique relative to said curtain section bases and said first pockets are partially closed, to a second limit position, in which said side legs are generally parallel to said curtain section bases and edgewisely abut in successive pairs against one another and said first pocket becomes generally closed; wherein said tilting means consists of a number of rigid, polygonal, flat members, each polygonal member being freely engaged into a curtain sheet second, generally closed pocket defined by a pair of adjacent sheet curtain section side legs from two successive said first pockets, each said second pocket being located at the top edge portion of said curtain far away from the bottom edge portion thereof so that most of said curtain sheet hangs freely beneath said polygonal members, each said second pocket defining top seat means against which edgewisely bears a corresponding said polygonal member, and means for supporting said polygonal member over ground and for pivoting same about a vertical axis; said polygonal member including at least a first peripheral bore, said supporting means including a plurality of hook members destined to slidingly engage a horizontal track, said horizontal track of the type to be anchored horizontally over a window frame to be concealed by said curtain, each said hook member destined to engage said first bore from a corresponding one of said polygonal members.

4. A sheet curtain as defined in claim 3, wherein each said polygonal member includes a second peripheral bore positioned opposite said first bore.

5. A sheet curtain as defined in claim 3, wherein each said polygonal member is rectangular and includes a second peripheral bore spaced from said first bore, said first bore being positioned lengthwisely and said second bore being positioned widthwisely on said rectangular member, said supporting means engaging a selected one of the two lateral bores, thus allowing two said sheet curtains of different side legs widths to be hooked on said track.

6. A sheet curtain as defined in claim 3, wherein each said polygonal member includes a plurality of spaced peripheral bores.

7. A sheet curtain as defined in claim 3, wherein said top seat means is composed of a few laterally spaced groups of stitches, said stitches spanning the top edges defined by said second pocket and interconnecting the top edges of the corresponding said pair of adjacent sheet sections, any two said groups of stitches being spaced from one another sufficiently so as to define a gap for inserting said supporting means through said gap and into said second pocket for releasable hooking and engagement with said polygonal member.

8. A sheet curtain as defined in claim 4, wherein said top seat means are composed of one pair of laterally spaced groups of stitches.

* * * * *